United States Patent [19]

Komamura et al.

[11] Patent Number: 4,950,584

[45] Date of Patent: Aug. 21, 1990

[54] HEAT-PROCESSABLE COLOR PHOTOSENSITIVE MATERIAL

[75] Inventors: Tawara Komamura; Masaru Tsuchiya; Ken Okauchi, all of Hino, Japan

[73] Assignee: Konica Corporation, Tokyo, Japan

[21] Appl. No.: 277,231

[22] Filed: Nov. 29, 1988

[30] Foreign Application Priority Data

Dec. 17, 1987 [JP] Japan ..... 62-320599

[51] Int. Cl.[5] ..... G03C 5/54; G03C 7/26

[52] U.S. Cl. ..... 430/351; 430/203; 430/214; 430/551; 430/544

[58] Field of Search ..... 430/551, 203, 214, 351, 430/544

[56] References Cited

U.S. PATENT DOCUMENTS 4,490,460 12/1984 Shimba et al. ..... 430/551
4,740,446 4/1988 Schranz et al. ..... 430/203
4,770,981 9/1988 Komamura et al. ..... 430/351

*Primary Examiner*—Paul R. Michl
*Assistant Examiner*—Thorl Chea
*Attorney, Agent, or Firm*—Jordan B. Bierman

[57] ABSTRACT

The method of processing a heat-processable color photosensitive material is disclosed. The photosensitive material comprises a support, provided thereon, a photosensitive layer containing a photosensitive silver halide, a dye-donor, a reducing agent and a binder, and a non-photosensitive layer containing at least a binder, wherein a coupler capable of coupling with an oxydized product of the reducing agent to form a substantially colorless product is contained in at least one of the photosensitive layer and the non-photosensitive layer, and is represented by Formula (1);

Formula (1)

wherein R represents one selected from the group consisting of an alkyl group and an aryl group; and X represents a group of the atoms necessary to form a 5- or 6-membered heterocyclic ring containing at least one selected from the group consisting of nitrogen, sulfur and oxygen.

46 Claims, No Drawings

HEAT-PROCESSABLE COLOR PHOTOSENSITIVE MATERIAL

FIELD OF THE INVENTION

This invention relates to a heat-processable color photosensitive material capable of obtaining color images by a heat-developing process and more particularly to a heat-processable color photosensitive material in which color images can be obtained by making use of a dye formed by reaction of a coupler with the oxidized product of a reducing agent, which is generated in a heat-developing process.

BACKGROUND OF THE INVENTION

A photosensitive material capable of easily and rapidly obtaining images by a developing process comprising a dry process using heat, i.e., a heat-processable photosensitive material, has been usually known. Such heat-processable photosensitive materials and the image forming processes thereof are described in, for example, Japanese Patent Examined Publication Nos. 43-4921 (1968) and 43-4924 (1968); The Fundamentals of Photographic Engineering, pp. 553–555, Corona Publishing Co., 1979; Research Disclosure, RD-17029, pp.9–15, June, 1978; and so forth.

In recent years, there have been some attempts to research and develop heat-processable color photosensitive materials in which color images are obtained by making selective use of various types of dye-donors. Among these attempts, there is a system for obtaining color images in such a manner that a diffusible dye is released or formed in a heat developing process and is then transferred. This system is excellent in stability and sharpness of images as well as in easiness and rapidness of processing operations. These dye-transfer type heat-processable color photosensitive materials and the image forming processes thereof are described in, for example, Japanese Patent Publication Open to Public Inspection (hereinafter called Japanese Patent O.P.I. Publication) Nos. 59-12431 (1984), 59-159159 (1984), 59-181345 (1984), 59-229556 (1984), 60-2950 (1985), 61-52643 (1986), 61-61158 (1986), 61-61157 (1986), 59-180550 (1984), 61-132952 (1986) and 61-139842 (1986); U.S. Pat. Nos. 4,595,652, 4,590,154 and 4,584,267; and so forth.

Besides the above, there are heat-processable photosensitive materials which use a coupler capable of forming a non-diffusible dye, such as those described in, for example, Japanese Patent O.P.I. Publication Nos. 62-44737 (1987), 62-129852 (1987) and 62-169158 (1987); and heat-processable photosensitive materials which use a coupler capable of forming a diffusible dye, such as those described in, for example, U.S. Pat. Nos. 4,631,251, 4,650,748, 4,656,124 and so forth. These photosensitive materials are excellent in that color images having a higher density and lower fogging can readily be obtained.

However, these heat-processable color photosensitive materials still have the problems remaining unsolved, such as not so satisfactorily lowered fogging, color mixed up by interlayer transfer of the oxidized products of a reducing agent, or seriously produced stains.

For the purpose of solving these problems, the compounds capable of capturing the useless oxidized products of a reducing agent, such as the couplers or the reducing agents described in, for example, Japanese Patent O.P.I. Publication Nos. 60-119555 (1985), 60-133449 (1985), 60-198540 (1985) and 60-230652(1985), each of which has already been known. The compounds described in these patent applications still have the problems; the oxidized products of a reducing agent are not satisfactorily captured, fogging is not satisfactorily lowered, and color mixing or fogging is produced by transfer of the colored compounds reacted with the oxidized products of a reducing agent: and besides the above problems, they have another problem that a maximum density as well as fogging is lowered to a large extent.

SUMMARY OF THE INVENTION

It is an object of the invention to provide a heat-processable color photosensitive material containing a compound capable of capturing efficiently the oxidized products of a reducing agent in the heat-processable conditions.

Another object of the invention is to provide a heat-processable color photosensitive material capable of obtaining color images having a high density and a low fogging.

An additional object of the invention is to provide a heat-processable color photosensitive material capable of obtaining color images having a high color purity.

The last object of the invention is to provide a heat-processable color photosensitive material improved in preservability.

The preceding objects of the invention can be achieved with a heat-processable color photosensitive material comprising a support provided thereon with at least a photosensitive silver halide, a dye-donor, a reducing agent, a binder and a coupler which is capable of forming a substantially colorless compound by coupling with the oxidized products of the reducing agent.

The coupler capable of forming the preceding colorless compound is contained in a photosensitive layer and/or a non-photosensitive layer which is provided if necessary. The coupler may be substituted at an active site thereof with an alkyl or aryl group.

DETAILED DESCRIPTION OF THE INVENTION

The coupler of the invention (hereinafter called the inventive coupler) capable of forming a substantially colorless compound by coupling with the oxidized products of the reducing agent is preferably a coupler substituted at an active site thereof with an alkyl group including a substituted alkyl group or an aryl group including a substituted aryl group, and more preferably a coupler substituted with an alkyl group.

The typical examples of the preceding alkyl group include a group of methyl, ethyl, n-propyl, n-butyl, n-octyl. n-dodecanyl or n-octadecanyl and, preferably a methyl or ethyl group.

The typical examples of the preceding aryl group include a phenyl group.

There is no special limitation to the substituents attached to the alkyl and aryl groups, and they are either a passive group described later or a group of aryl, alkoxy, hydroxy, sulfamoyl or carbamoyl.

The preceding couplers can have such a main structure as a known coupler usually applied to conventional photosensitive materials. In case of a coupler having such main structure as what is capable of forming a dye by coupling with the oxidized products of a reducing agent, it is inevitable for the coupler to be substituted at the active site thereof with an alkyl or aryl group.

The particularly preferable inventive couplers are represented by the following formula:

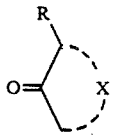

Formula (1)

wherein R represents an alkyl group including a substituted alkyl group or an aryl group including a substituted aryl group, each substituted at an active site of the coupler: and X represents a group consisting of the atoms necessary to form a 5- or 6-membered heterozyclic ring containing at least one nitrogen, sulfur or oxygen atom, and further the heterocyclic ring may form a condensed ring with other ring or have a substituent on the ring.

If required, the couplers represented by Formula (1) may further have an passive group on either the ring or the alkyl group represented by R, having such size and/or structure as capable of making the couplers themselves passive in the course of processing and/or storage. Such passive groups include an organic group, having not less than 12 carbon atoms or a polymer residue.

The preferable examples of the inventive couplers represented by Formula (1) are those represented by the following Formulas (2) through (9) and, among them, the compounds represented by Formula (3) are particularly preferable.

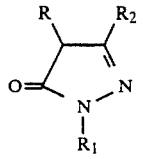

Formula (2)

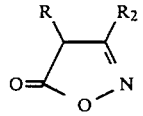

Formula (3)

-continued

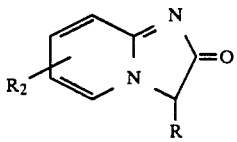

Formula (4)

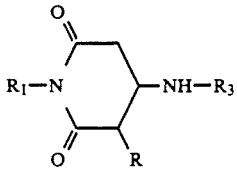

Formula (5)

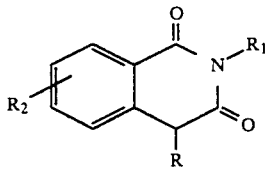

Formula (6)

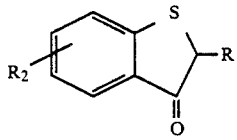

Formula (7)

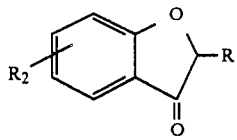

Formula (8)

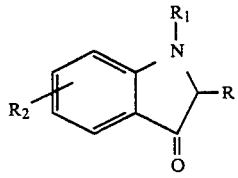

Formula (9)

In the preceding Formulas, R represents the same as defined in Formula (1); and $R_1$ and $R_3$ represent independently a substituted or non-substituted alkyl or aryl group.

$R_2$ represents a substituted or non-substituted alkyl, aryl, alkylamino, arylamino, acylamino, ureido, cyano or carbamoyl group, and R and $R_2$ or $R_3$ may couple together to form a ring.

The typical examples of the inventive couplers represented by Formula (1) are given below:

SC-1

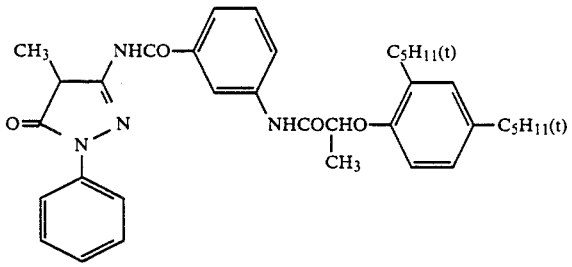

-continued
SC-2
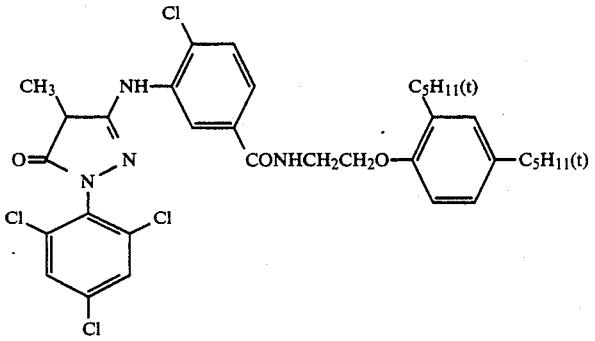
SC-3
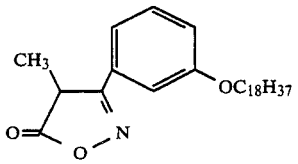
SC-4
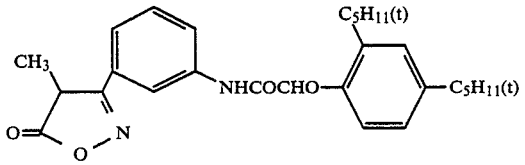
SC-5
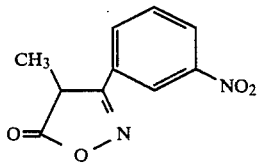
SC-6
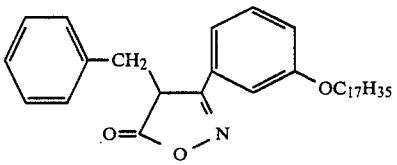
A copolymer of
SC-7
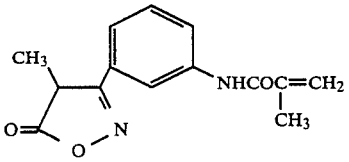
and BA (Composition ratio: 1/1 (by weight))
A copolymer of
SC-8
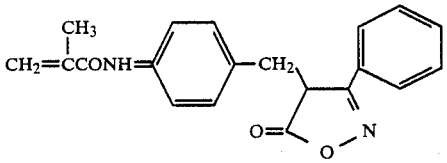
and BA (The same as above)
A copolymer of
SC-9

-continued
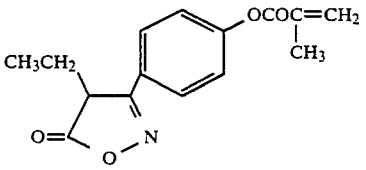
and MA
(Composition ratio:
3/2)
A copolymer of
SC-10
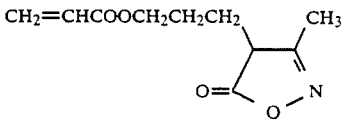
and BA
(Composition ratio:
3/2)
BA: Butyl acrylate
MA: Methyl acrylate
SC-11
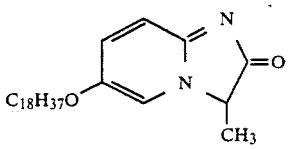
SC-12
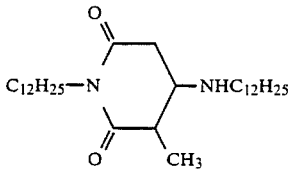
SC-13
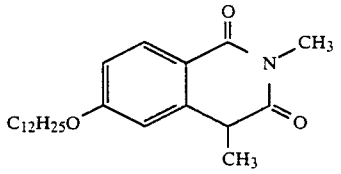
SC-14
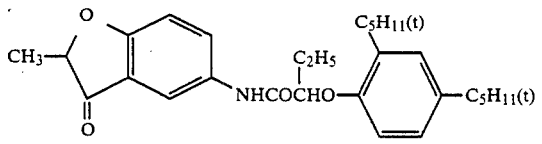
SC-15
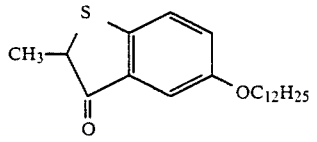
SC-16
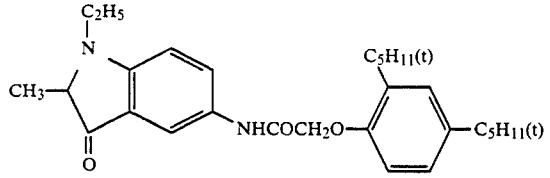

-continued
SC-17
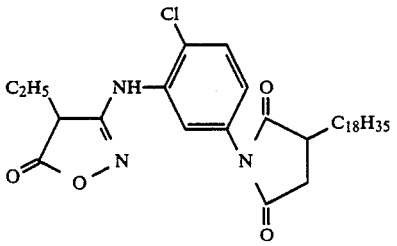
SC-18
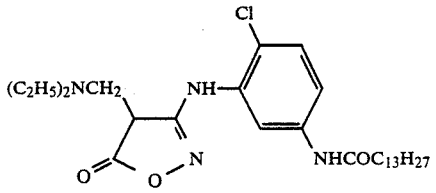
SC-19
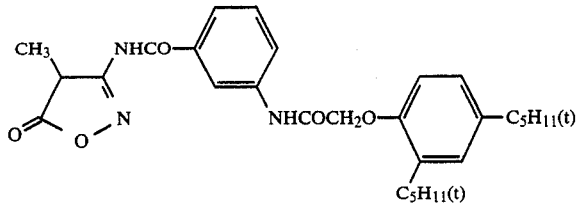
SC-20
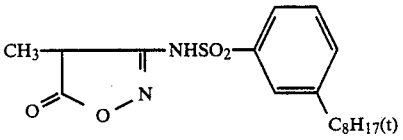
SC-21
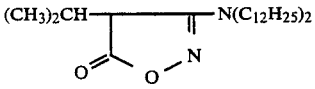
SC-22
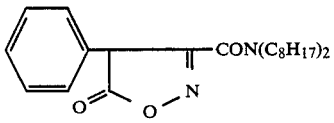
SC-23
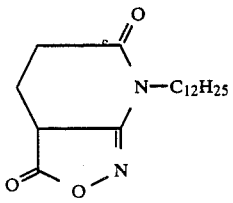
SC-24
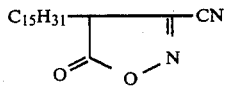
SC-25
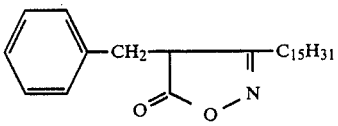
SC-26
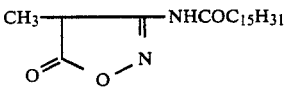

-continued

SC-27

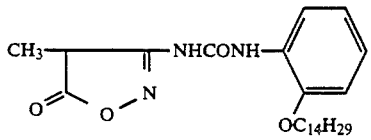

SC-28

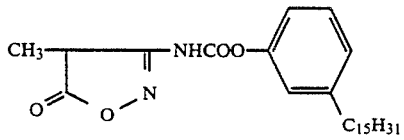

SC-29

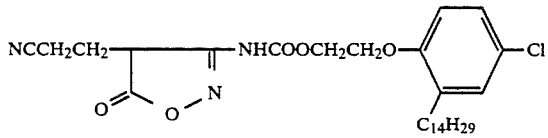

SC-30

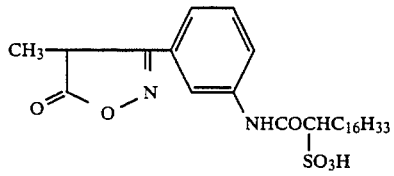

SC-31

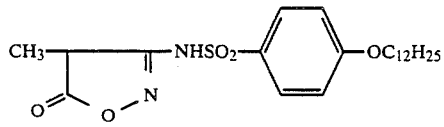

The inventive coupler may be added into a photosensitive layer or a non-photosensitive layer by purpose. When adding it into a photosensitive layer, the addition amount preferably ranges from 0.01 mol to 1 mol per mol of a dye-donor and more preferably from 0.05to 0.5 mol.

When adding it into a non-photosensitive layer, the addition amount preferably ranges from $1.0\times10^{-5}$ to $1.0\times10^{-2}$ mol/m$^2$ of the layer and more preferably from $1.0\times10^{-4}$ to $5.0\times10^{-3}$ mol/m$^2$.

Any methods may be taken to incorporate the inventive coupler. For example, the coupler is dissolved in a low boiling point solvent such as methanol, ethanol, ethyl acetate and/or a high boiling point solvent such as dibutyl phthalate, dioctyl phthalate, tricresyl phosphate and is supersonically dispersed. The coupler may be dispersed together with a dye-donor when incorporating into a photosensitive layer, or, after the coupler is dissolved in an aqueous alkaline solution such as a 10% aqueous solium hydroxide solution, the resulting solution is neutralized with a mineral acid such as chloric acid, nitric acid in prior to using.

Generally, the inventive coupler represented by Formula (1) is synthesized by the following method:

(1) Synthesis of a linear compound of which active methylene group is substituted with an alkyl group → cyclization, and (2) Synthesis of a cyclic compound having an active methylene group → introduction of an active methylene alkyl group.

A typical example of synthesizing the inventive coupler is described below:

Synthesis of SC-3

50 g of m-(n-octadecyloxy)benzoyl methyl acetate were dissolved in 150 ml of dimethylformamide, and then 14 g of t-butoxy potassium were added. After the reactant was stirred for a while and 18 g of methyl iodide was then added it was heated at 70° to 80° C. for 15 hours. The reactant solution was poured into 500 ml of water and the deposited substances were filtrated. The substances were recrystallized with acetonitrile to obtain 42 g of α-[m-(n-octadecyloxy)benzoyl]-methylpropionate.

38 g of the obtained intermediate were put into 170 ml of ethanol and stirred. To the resultant was added 6.3 g of hydroxyamine chloride, and then 16.6 g of potassium hydroxide was added in 30 minutes. After stirring for two hours at room temperature, the reactant was poured into water and acidified with dilute sulfuric acid, and the precipitated substances were filtrated. The substances were recrystallized with ethanol and then with acetonitrile to obtain 32g of the objective material.

The melting point was 88 to 90° C.

The dye-donors used in of the invention include, for example, the couplers capable of forming non-diffusible dyes, described in Japanese Patent O.P.I. Publication No. 62-44737(1987), 62-129852 (1987) and 62-169158 (1987); leuco dyes described in U.S. Pat. No. 475,441; and azo dyes applicable to a heat-processable dye bleaching process, described in U.S. Pat. No. 4,235,957; and so forth. Those more preferable include diffusible dye-donors capable of forming or releasing a diffusible dyes, and those particularly preferable include the compounds capable of forming diffusible dyes by coupling reaction.

The dye-donors used in the invention include the coupling-dye releasing type compounds such as those described in U.S. Pat. No. 4,474,867; Japanese Patent O.P.I. Publication Nos. 59-12431 (1984), 59-48765(1984) 59-174834 (1984), 59-776642 (1984), 59-159159 (1984) and 59-231540 (1984); and so forth.

The other particularly preferable dYe-donors materials include the coupling dye-forming type compounds represented by the following Formula (10);

$$Cp\text{-}(J)(B) \qquad \text{Formula (10)}$$

wherein Cp represents an organic group capable of forming a diffusible dye by coupling with an oxidized product of a reducing agent, and J represents a divalent joint group substituted at an active site of a coupler; B represents a ballast group. The term 'ballast group' stated herein represents a group having the function of making a dye-donor substantially undiffusible in the course of a heat-developing process, including such groups as a sulfo group having the function derived from its molecular property and a group having a relatively large number of carbon atoms, which has the function derived from its molecular size. The coupler residues represented by Cp include, preferably, those having a molecular weight of not more than 700, more preferably not more than 500, so as to make diffusibility of a formed dye more efficient.

The ballast group include those having preferably not less than 8 carbon atoms, more preferably not less than 12 carbon atoms or a sulfo group, further preferably those having both of the preceding groups and, particularly preferably a polymer-chain group.

The coupling dye-forming type compounds having the foregoing polymer-chain groups are represented by the following Formula (11), which have a polymer-chain comprising a repeating unit composed of a monomer.

$$Cp\text{-}(J)(Y)_l(Z)(L) \qquad \text{Formula (11)}$$

wherein Cp and J represent the same as those defined in Formula (10); Y represents a group of alkylene, arylene or aralkylene; l represents an integer of 0 or 1; Z represents a divalent organic group; and L represents an ethylene-unsaturated group or a group having an ethylene-unsaturated group.

The typical examples of the coupling dye-forming compounds represented by Formulas (10) and (11) include. preferably, the polymer type dye-donors specified in Japanese Patent O.P.I. Publication Nos. 59-124339 (1984), 59-181345 (1984), 60-2950 (1985), 61-57943 (1986) and 61-59336 (1986); U.S. Pat. Nos. 4,631,251, 4,650,748 and 4,656,124; and, particularly, specified in U.S. Pat. Nos. 4,656,124, 4,631,251 and 4,650,748.

These dye-donors may be used independently or in combination. The amount used is not limitative, but may be determined in accordance with the kinds thereof, independent or combination use, the single- or multi-layers of the photosensitive materials and so forth. However, they are used in an amount of 0.005g to 50 g/m$^2$ of a support and more preferably 0.1to 10 g/m$^2$ of a support.

There is no special limitation to the methods for incorporating a dye-donor used in the invention into the photographic component layers of a heat-processable photosensitive material. For example, the dye-donors are dissolved in a low boiling point solvent such as methanol, silver halide grains having such a silver halide composition as is varied stepwise or continuously.

A crystal shape of silver halide grain may be an isotropic crystal such as a cube, spherule, octahedron, dodecahedron, tetradecahedron and so forth, or an anisotropic crystal. This kind of silver halide is described in Japanese Patent O.P.I. Publication No. 60-215948 (1985).

As described in Japanese Patent O.P.I. Publication Nos. 58-111933 (1983), 58-111934 (1983), 58-108526 (1983) and Research Disclosure No. 22534, it is also allOWable to use a silver halide emulsions containing tabular silver halide grains which comprise two parallel crystal planes having broader area than that of the other planes, wherein an aspect ratio of the grains, i.e., a ratio of a grain diameter to a grain thickness, is not less than 5 : 1.

In the invention, it is further allowable to use a silver halide emulsion containing internal latent image type silver halide grains having the surfaces not yet fogged in advance. Such silver halide grains as described above are specified in U.S. Pat. Nos. 2,592,250, 3,206,313, 3,317,322, 3,511,622, 3,447,927, 3,761,266, 3,703,584 and 3,736,140 and so forth. The term 'an internal latent image type silver halide grains having the surfaces not yet fogged in advance' is defined by a silver halide grain of which sensitivity inside the grains is higher than that on the ethanol, ethyl acetate, or in a high boiling point solvent such as dibutyl phthalate, dioctyl phthalate, tricresyl phosphate and then are supersonically dispersed; the dye-donors are dissolved in an aqueous alkaline solution such as a 10% aqueous sodium hydroxide solution and then are neutralized with an acid such as citric acid, nitric acid; or the dye-donors are dispersed in an appropriate aqueous polymer solution such as that of gelatin, polyvinyl butyral, polyvinyl pyrolidone or by making use of a ball-mill.

Next, the photosensitive silver halides applicable to the invention are described.

There is no limitation to the silver halides applicable to the invention. The silver halides include silver chloride, silver bromide, silver iodide, silver bromochloride, silver chloroiodide, silver bromoiodide and so forth. The photosensitive silver halides are prepared in any processes such as a single-jet process generally known in the photographic art. In the present invention, it is preferable to use a silver halide emulsion containing multishell silver halide grains.

In this invention, it is allowable to use an emulsion comprising the grains having such a multilayered structure that a surface composition of the silver halide grains is different from an interior. For example, it is allowable to use a silver halide emulsion containing core/shell type surface, as described in the above patent specifications.

Besides the above, it is allowable to use silver halide emulsions containing silver halide grains incorporated thereinto with polyvalent metal ions, such as those described in U.S. Pat. Nos. 3,271,157, 3,447,927 and 3,531,291; silver halide emulsions comprising dopant-containing silver halide grains having the surface chemically sensitized slightly, such as those described in U.S. Pat. No. 3,761,276; silver halide emulsions comprising grains having a multilayered structure, such as those described in Japanese Patent O.P.I. Publication Nos.

50-8524 (1975), 50-38525 (1975) and so forth; silver halide emulsions described in Japanese Patent O.P.I. Publication Nos. 52-156614 and 55-127549 (1980); and so forth.

The preceding photosensitive silVer halide emulsions may be chemically sensitized in any conventional processes known in the fields of a photographic art.

The silver halides contained in the preceding photosensitive emulsions may be either coarse or fine grains. A grain size thereof is preferably about 0.001μm to about 1.5μm and, more preferably about 0.01μm to 0.5μm.

In the invention, as for the other process of preparing the silver halides for a photosensitive material, a photosensitive silver halide may be deposited partially on an organic silver salt described later in coexistence of a photosensitive silver salt forming component and the organic silver salt.

These photosensitive silver halides and photosensitive silver salt forming components may be used in any modes of combination. They are preferably used in an amount of 0.001 g to 50 g/m$^2$ of a support per layer and more preferably 0.1 g to 10 g/m$^2$.

The typical examples of spectral sensitizing dyes applicable to the invention include cyanine, merocyanine, complexed (trinuclear or tetranuclear) cyanine, holopolar cyanine, styryl, hemicyanine, oxonol and so forth.

The amount of these sensitizing dyes are preferably $1\times10^{-4}$ mol to 1 mol per mol of photosensitive silver halide or silver halide forming component and, more preferably $1\times10^{-4}$ mol to $1\times10^{-1}$ mol.

Into the heat-processable photosensitive materials of the invention, a variety of organic salts may be incorporated, if necessary, for the purpose of improving sensitivity and developability.

The examples of the organic silver salts applicable to the heat-processable photosensitive materials of the invention are given as follows; namely, long-chained aliphatic carboxylic acid silver salts and carboxylic acid silver salts having heterocyclic rings, such as silver laurate, silver myristate, silver palmitate, silver stearate, silver arachidonate, silver behenate, silver α-(1-phenyltetrazolethio) acetate and so forth, and besides above, such an aromatic silver carboxylate as silver benzoate, silver phthalate and so forth, all of which are described in Japanese Patent O.P.I. Publication Nos. 53-4921 (1978), 49-52626 (1974), 52-141222 (1977), 53-36224 (1978), 53-37626 (1978) and 53-37610 (1978), U.S. Pat. Nos. 3,330,633, 3,794,496 and 4,105,451, and so forth; and silver salts having an imino group are described in Japanese Patent Examined Publication Nos. 44-26582(1969), 45-12700 (1970), 45-18416 (1970) and 45-22185 (1970), Japanese patent O.P.I. Publication Nos. 52-137321 (1977), 58-118638 (1983) and 58-118639 (1983), and U.S. Pat. No. 4,123,274.

In addition to the above, it is also alloWable to use a silver complex compound having a stability constant of 4.5to 10.0 such as those described in Japanese Patent O.P.I. Publication No. 52-31728 (1977), a silver salt of imidazolinethione such as those described in U.S. Pat. No. 4,168,980, and so forth.

Among the preceding organic silver salts, a silver salt having an imino group and, particularly, a silver salt of a benzotriazole derivative is preferred. The silver salts of 5-methylbenzotriazole and the derivatives thereof, sulfobenzotriazole and the derivatives thereof and N-alkylsulfamoylbenzotriazole and the derivatives thereof are more preferred.

The organic silver salts applicable to the invention may be used independently or in combination. It is also allowable to prepare a silver salt in an appropriate binder and to use it as it is without isolating, or to use an isolated silver salt dispersed in a binder by an appropriate means. Such dispersing means include a ball-mill, a sand-mill, a colloid-mill, an oscillation-mill and so forth.

The processes for preparing an organic silver salt include such a process that silver nitrate and an organic compound as a starting material are dissolved and mixed in either water or an organic solvent. It is also effective to add a binder or an alkaline material such as sodium hydroxide so as to accelerate dissolution of an organic compound or to use an ammonia silver nitrate solution.

The preceding organic silver salt is usually applied in an amount of 0.01 mol to 500 mol per mol of photosensitive silver halides, preferably 0.1 to 100 mol and, more preferably 0.3 to 30 mol.

The reducing agents applicable to the heat-processable photosensitive materials of the invention may be those usually applicable to the field of heat-processable photosensitive materials.

The reducing agents applicable to the invention include a p-phenylenediamine type or a p-aminophenol type developing agent, a phosphoramidophenol type or a sulfonamidaniline type developing agent, a hydrazone type developing agent and the precursors thereof, or, phenols, sulfonamidophenols, polyhydroxybenzenes, naphthols, hydroxybinaphthyls, methylene bisnaphthols, methylene bisphenols, ascorbic acid, 3-pyrazolidones, and pyrazolones, such as those described in U.S. Pat. Nos. 3,531,286, 3,761,270 and 3,764,328, Research Disclosure Nos. 12146, 15108 and 15127, Japanese Patent O.P.I. Publication No. 56-27132 (1981), U.S. Pat. Nos. 3,342,599 and 3,719,492, Japanese Patent O.P.I. Publication Nos. 53-135628 and 57-79035 (1982), and so forth.

Particularly preferable reducing agents include N-(p-N,N-dialkyl)phenylsulfamate described in Japanese Patent O.P.I. PublicatiOn No. 56-146133 (1981) and 62-227741 (1987).

Two or more kinds of the preceding reducing agents may be used together.

The amount of the reducing agents is variable by kinds of a photosensitive silver halide, an organic acid silver salt and the other additives. They are usually used in an amount of, preferably. 0.01 to 1500 mols per mol of a photosensitive silver halide and, more preferably 0.1to 200 mol.

The binders applicable to the heat-processable photosensitive materials of the invention include synthetic or natural high molecular weight substances such as polyvinyl butyral, polyvinyl acetate, ethyl cellulose, polymethyl methacrylate, cellulose acetate butyrate, polyvinyl alcohol, polyvinyl pyrolidone, gelatin, a gelatin derivative such as phthalated gelatin, cellulose derivatives, protein, starch, gum arabic and so forth. They may be used independently or in combination. In particular, it is preferred to use gelatin or the derivatives thereof and a hydrophilic polymer such as pyrolidone and polyvinyl alcohol in combination. It is more preferred to use a mixed binder of gelatin and polyvinyl pyrolidone, is described in Japanese Patent O.P.I. Publication No. 59-229556 (1984).

A binder is usually used in an amount of, preferably 0.05g to 50 g/m$^2$ of a support and, more preferably 0.1 g to 10 g/m$^2$.

Also, the binder is used in an amount of, preferably, 0.1 g to 10 g per gram of a dye-donor and, more preferably 0.25 to 4 g.

The heat-processable photosensitive materials of the invention are prepared by forming a photographic component layers on a support. The examples of the support in include synthetic plastic films made of polyethylene, cellulose acetate, polyethylene terephthalate or polyvinyl chloride, or paper supports such as photographic base paper, printing paper, baryta paper, resin-coated paper or supports on which an electron-beam curing resin is coated and cured.

In the case where a heat-processable photosensitive material of an image-transfer type is used together with an image-receiving material in the invention, and it is preferable to use a variety of heat solvents for the preceding materials. The term 'a heat solvent' means a compound capable of accelerating a heat development and/or a heat transfer. This kind of the compounds include an organic compound having such a polarity as described in U.S. Pat. Nos. 3,347,675 and 3,667,959, Research Disclosure No. 17643 (XII), Japanese Patent O.P.I. Publication Nos. 59-229556 (1984), 59-68730 (1984), 59-84236 (1984), 60-191251 (1985), 60-232547 (1985), 60-14241 (1985), 61-52643 (1986), 62-78553 (1987), 62-42153 (1987) and 62-44737 (1986), U.S. Pat. Nos. 3,438,776, 3,666,477 and 3,667,959, and Japanese Patent O.P.I. Publication Nos. 51-19525 (1976), 53-24829 (1978), 53-60223 (1978), 58-118640 (1983) and 58-198038 (1983). The compounds particularly useful in embodying the inVention include urea derivatives such as dimethyl urea, diethyl urea and phenyl urea, amide derivatives such as acetamide, benzamide, p-toluamide and p-butoxybenzamide, sulfonamide derivatives such as benzenesulfonamide and $\alpha$-toluene sulfonamide, polyhydric alcohols such as 1.5-pentanediol, 1,6-hexanediol, 1.2-cyclohexanediol, pentaerythritol and trimethylolethane, or polyethylene glycols.

As for the heat solvents, a water-insoluble solid heat solvent is further preferably used. The term 'a water-insoluble solid heat solvent' means a compound which is in a solid state at an ordinary temperature and in a liquid state at a temperature higher than 60° C. preferably higher than 100° C. and, more preferably at the range of 130° C. to 250° C., wherein the compound has a ratio of inorganic property to organic property (Refer to 'Organic Conception Chart' by Yoshio Kohda, Sankyo Publishing Co., 1984) at the range of 0.5 to 3.0, preferably 0.7 to 2.5, and more preferably 1.0 to 2.0.

The typical examples of the preceding water-insoluble heat solvents are described in Japanese Patent Application Nos. 60-278331 (1985) and 60-280824 (1985).

The layers into which a heat solvent is incorporated are a photosensitive silver halide emulsion layer, an interlayer, a protective layer, an image-receiving layer of an image-receiving material and so forth.

A heat solvent is usually added in an amount of, preferably, 10% to 500% by weight of a binder and, more preferably, 30% to 200% by weight.

The heat-processable photosensitive materials of the invention may be incorporated with a variety of additives if necessary, besides the preceding components.

The heat-processable photosensitive materials of the invention may be incorporated also with a color modifier which is known in the art of heat-processable photosensitive material, as a development accelerator. Such color modifiers include, the compounds described in, Japanese Patent O.P.I. Publication Nos. 46-4928 (1971), 46-6077 (1971), 49-5019 (1974), 50-2524 (1975), 50-67132 (1975), 50-67641 (1975), 50-114217 (1975), 52-33722 (1977), 52-99813 (1975), 53-1020 (1978), 53-55115 (1978), 58-76020 (1978), 53-125014 (1978), 54-156523 (1979), 54-156524 (1979), 54-156525 (1979), 54-156526 (1979), 55-4060 (1980), 55-4061 (1980), 55-32015 (1980) and so forth, West German Patent Nos. 2,140,406, 2,147,063 and 2,220,618, U.S. Pat. Nos. 3,847,612, 3,782,941, 4,201,582 and so forth, Japanese Patent O.P.I. Publication Nos. 57-207244 (1982), 57-207245 (1982), 58-1896328 (1983) and 58-193541 (1983), and so forth.

Other development accelerators include the compounds described in Japanese Patent O.P.I. Publication Nos. 59-177550 (1984) and 59-111636 (1984). It is further allowable to use the development accelerator releasing compounds described in Japanese Patent O.P.I. Publication No. 61-159642 (1986).

Antifoggants include higher fatty acids described in U.S. Pat. No. 3,645,739, mercuric salts described in Japanese Patent Examined Publication No. 47-11113 (1972), N-halides described in Japanese Patent O.P.I. Publication No. 51-47419 (1976), mercapto compound-releasing compounds described in U.S. Pat. No. 3,700,457 and Japanese Patent O.P.I. Publication No. 51-50725 (1976), arylsulfonic acids described in Japanese Patent O.P.I. Publication No. 49-125016 (1974), lithium carboxylate described in Japanese Patent O.P.I. Publication No. 51-47419 (1976), oxidizing agents described in British Patent No. 1,455,271 and Japanese Patent O.P.I. Publication No. 50-101019 (1975), sulfinic acids or thiouracils described in Japanese Patent O.P.I. Publication No. 53-19825 (1978), disulfide and polysulfide compounds described in Japanese Patent O.P.I. Publication Nos. 51-81124 (1976) and 55-93149 (1980), rosins or diterpenes described in Japanese Patent O.P.I. publication No. 51-57435 (1976), acid polymerides having free carboxyl group or sulfonic acid group described in Japanese Patent O.P.I. publication No. 51-104338 (1976), thiazolinthione described in U.S. Pat. No. 4,138,265, 1,2,4-triazole or 5-mercapto-1,2,4-triazole described in Japanese Patent O.P.I. Publication No. 54-51821 (1979) and U.S. Pat. No. 4,137,079, 1,2,3,4-thiatriazoles described in Japanese Patent O.P.I. Publication No. 55-142331 (1980), dihalides or trihalides described in Japanese Patent O.P.I. Publication Nos. 59-46641 (1984), 59-57233 (1984) and 59-57234 (1984), thiol compounds described in Japanese Patent O.P.I. Publication No. 59-111636 (1984), hydroquinone derivatives described in Japanese Patent O.P.I. Publication No. 60-198540 (1985), combination use of hydroquinone derivatives and benzotriazole derivatives described in Japanese Patent O.P.I. Publication No. 60-227255 (1985), and so forth.

Besides the above, the particularly preferable antifoggants include inhibitors having hydrophilic groups. described in Japanese Patent Application No. 60-218169 (1985), polymer inhibitors described in Japanese Patent O.P.I. Publication No. 62-121452 (1987) and inhibitors having ballast groups described in Japanese Patent O.P.I. Publication No. 62-123456 (1987).

It is further allowable to add a basic inorganic or organic, or a basic precursor. The basic precursors include compounds such as guanidinium trichloroacetate which is capable of releasing a basic substance upon decarboxylation by heating, and compounds capable of releasing amines after the compounds are decomposed by an intermolecular nucleophilic substitution reaction. Such base-releasing agents are described in Japanese Patent O.P.I. Publication Nos. 56-130745 (1981) and 56-132332 (1981), British Patent No. 2,079,480, U.S. Pat. No. 4,060,420, Japanese Patent O.P.I. Publication Nos. 59-157637 (1984), 59-166943 (1984), 59-180537 (1984), 59-174830 (1984) and 59-195237 (1984).

Besides the above, a variety of additive may be added, if required, to heat-processable photosensitive materials. These additives include an antihalation dyestuff, a fluorescent whitening agent, a hardener, an antistatic agent, a plasticizer, a spreading agent, a matting agent, a surfactant, an anti-discoloring agent and so forth, described in Research Disclosure. Vol. 170, June, 1978, No. 17029, Japanese Patent Application No. 60-276615 (1985), and so forth.

The heat-processable photosensitive materials of the invention contain (a) a photosensitive silver halide, (b) a reducing agent, (c) a binder and, if they are color photosensitive materials, (d) a dye-donor and (e) an organic silver if necessary. They may be contained essentially in one heat-processable photosensitive layer. However, they may not always be contained in only one photographic component layer. For example, a heat-processable photosensitive layer is divided into two layers and the preceding components of (a), (b), (c) and (e) are contained in one of the heat-processable photosensitive layers and a dye-donor (d) is contained in another photosensitive layer which is adjacent to the former layer. These components may also be contained in two or more layers so that the components in the different layers can react with each other.

It is further allowable to divide a heat-processable photosensitive layer into two layers, namely, a low-sensitive layer and a high-sensitive layer or a low density layer and a high density layer, or into more layers.

The heat-processable photosensitive materials of the invention comprise one or more heat-processable photosensitive layers, and; in the case of a full-color photosensitive material, it usually comprises three heat-processable photosensitive layers of different color sensitivity, wherein the dyes of different hue are formed or released in each of the photosensitive layers by heat processing.

In general, the photosensitive layers are composed in such combination that a blue-sensitive layer contains a yellow dye, a green-sensitive layer does a magenta dye and a red-sensitive layer does a cyan dye, respectively. However, there is no limitation to this combination. It is also allowable to combine a near infrared sensitive layer therewith.

Any arrangement of each layer may freely be selected so as to meet the requirements of objects. For example, a red-sensitive layer, a green-sensitive layer and a blue-sensitive layer may be arranged in this order over a support. On the contrary, a blue-sensitive layer, a green-sensitive layer and a red-sensitive layer may be arranged in this order, or a green-sensitive layer, a red-sensitive layer and a blue-sensitive layer may be arranged in this order.

The heat-processable photosensitive materials of the invention may also be provided with non-photosensitive layers such as an under-coat layer, an interlayer, a protective layer, a filter layer, a backing layer, a peeling-off layer and so forth, besides the preceding heat-processable photosensitive layers. In order to coat the preceding heat-processable photosensitive layers and non-photosensitive layers over a support, it is allowable to apply the conventional processes used for coating ordinary silver halide photosensitive materials.

After the heat-processable photosensitive materials of the invention are exposed imagewise to light, they are developed usually only by heating them at a temperature of, preferably 80° C, to 200° C. and, more preferably 100° C. to 170° C. for a period of, preferably one to 180 seconds and, more preferably 1.5 to 120 seconds. Transferring of diffusible dyes to an image-receiving layer of an image-receiving material is performed in such a manner that a photosensitive layer of a photosensitive material is sticked to an image-receiving layer in heat-processing, or that a photosensitive layer is sticked to an image-receiving layer after heat-processing, or after supplying water and heating if necessary. Further, pre-heating may be provided at a temperature of 70° C. to 180° C. before exposing. Additionally, for the purpose of improving stickiness of the photosensitive and image-receiving layers as described in Japanese Patent O.P.I. Publication No. 60-143338 (1985) and 61-162041 (1986), a photosensitive material and an image-receiving material may be pre-heated respectively, at a temperature of 80° C. to 250° C., just before heat-processing and transferring.

The heat-processable photosensitive materials of the invention may be heated by various types of heating means.

It is allowable to utilize all kinds of conventional heating means applicable to heat-processing photosensitive materials. For example, the heat-processable photosensitive materials may be heated by contacting with a heated block or plate; by contacting with a heat roller or heat drum; by passing through a high temperature atmosphere; by high frequency heating; or by Joule heating generated from a conductive layer charged with electricity, provided on a back face of a photosensitive material or an image receiving material. There is no special limitation to the heating patterns. Therefore, any patterns may be applicable; heating again after preheating; heating at higher temperature for short time or at lower temperature for long time: raising or lowering temperature continuously, or repeating raising and lowering temperature; further, heating discontinuously. A simple heating pattern is preferable. A photosensitive material may be exposed and heated simultaneously.

In the case of a transfer type heat-processable photosensitive material of the invention, an image-receiving layer of an image-receiving material may be such a layer as having a function of receiving the dyes released or formed in a heat-processable photosensitive layer by a heat-processing. These image-receiving layers include, for example, those formed of a heat-resistive organic polymers having a glass-transition temperature of 40° C. to 250 ° C., described in Japanese Patent O.P.I. Publication No. 57-207250 (1982) and so forth.

The preceding polymers may be provided on a support as an image-receiving layer or compose the support itself.

The preceding heat-resistive polymers include polystyrene. polystyrene derivatives having a substituent of not more than 4 carbons, polyvinyl cyclohexane, polydivinyl benzene, polyvinyl pyrolidone, polyvinyl carbazole, polyallyl benzene, polyvinyl alcohol, polyacetals such as polyvinyl formal and polyvinylbutyral, polyvinyl chloride, chlorinated polyethylene, trichlorofluoro polyethylene, polyacrilonitrile, poly-N,N-dimethyl allylamide, polyacrylate having a p-cyanophenyl, pentachlorophenyl or 2,4-dichlorophenyl group, polyacrylchloracrylate, polymethyl methacrylate, polyethyl methacrylate, polypropyl methacrylate, polyisopropyl methacrylate, polyisobutyl methacrylate, poly-tert-butyl methacrylate, polycyclohexyl methacrylate, polyethyleneglycol methacrylate, poly-2-cyanoethyl methacrylate, polyesters such as polyethylene terephthalate, polysulfone, polycarbonates, polyanhydrides, polyamides and cellulose acetates. Further, synthetic polymers having a glass transition temperature higher than 540° C. described in J. Brandrup E. H. Immergut, 'Polymer Handbook', 2nd Ed., John Wiley Sons, is also useful. Generally, a preferable molecular weight of the preceding polymers ranges from 2,000 to 200,000. These polymers may be used independently or blending two or more. They may also be used as copolymers.

The particularly preferable image-receiving layers include the layers comprising of polyvinyl chloride described in Japanese Patent O.P.I. Publication No. 59-22342 (1984) and comprising of polycarbonate and a plasticizer described in Japanese Patent O.P.I. Publication No. 60-19138 (1985).

The preceding polymers may be used as an integrated material, for both of a support and an image-receiving layer, wherein the support may be composed of either a single layer or multi layers.

The supports for an image-receiving material, may be transparent or opaque. These supports include film of polyethylene terepthalate, polycarbonate, polystyrene, polyvinyl chloride, polyethylene, polypropylene, film of the preceding resins provided therein with pigments such as titanium oxide, barium sulfate, calcium carbonate, tarc or the like, baryta paper, resin-coated paper laminated with a thermoplastic resin containing pigments, cloths, glass, metal such as aluminum or the like, the supports coated on the preceding materials with an electron-beam curing resin containing pigments, the supports of these types provided thereon with a coating layer containing pigments. Besides the above, a cast coated paper described in Japanese Patent O.P.I. Publication No. 62-28333 (1987) is also useful for the supports.

In the paper support coated thereon with an electron-beam curing resin containing pigments, or in the paper support having a pigment-coated layer further coated thereon with an electron-beam curing resin, it will be possible to use the resin layer itself as an image-receiving layer. Therefore, these supports can be used for the image-receiving materials as they are.

The heat-processable photosensitive materials of the invention may be the so-called monosheet type heat-processable photosensitive materials provided on the same support with both a photosensitive layer and an image-receiving layer, described in Research Disclosure No. 15108, Japanese Patent O.P.I. Publication Nos. 57-198458 (1982), 57-207250(1982) and 61-80148 (1986).

The heat-processable photosensitive materials of the invention is preferably provided with a protective layer.

Such protective layer may contain a variety of additives applicable to a photographic art. These additives include matting agents, colloidal silica, lubricants, organic fluoride such as a fluorinated surfactant, antistatic agents, UV absorvers, high boiling point organic solvents, anti-oxidizing agents, hydroquinone derivatives, polymer latexes, surfactants including a high molecular weight surfactant, hardners including a high molecular weight hardener, organic silver salt grains, non-photosensitive silver halide grains, and so forth.

The details of these additives are described in Research Disclosure. Vol. 170; June, 1978, No. 17029, and Japanese Patent O.P.I. PubliCation No. 62-135825 (1987).

EXAMPLES

The examples of the invention are described below. It is, however, to be understood that the invention shall not be limited thereto.

Example-1

[Preparation of silver bromoiodide emulsion]

Solutions B and C of the following compositions were added to Solution A at 50° C. mixing with the stirrer described in Japanese Patent O.P.I. Application No. 57-92523 (1982) and 57-92524 (1987), wherein pAg was kept constant.

The aimed shape and size of silver halide grains were controlled by pH, pAg and the addition rates of Solutions B and C. Thus, a core emulsion comprising octahedral silver halide grains having a silver iodide content of 7 mol% and an average grain size of 0.25μm was prepared.

| | |
|---|---|
| Solution A | |
| Osein gelatin | 20 g |
| Ammonia (28% aqueous solution) | 15 ml |
| Distilled water | 1000 ml |
| Solution B | |
| Potassium bromide | 131 g |
| Potassium iodide | 11.6 g |
| Distilled water | 500 ml |
| Solution C | |
| Silver nitrate | 170 g |
| Ammonia (28% aqueous solution) | 130 ml |
| Distilled water | 500 ml |

Next, in the same manner as the above, a core/shell type silver halide emulsion was prepared, wherein the emulsion contained octahedral silver halide grains having an average grain size of 0.3μm and silver iodide content of 1 mol% in the shell. The monodispersibility was at 9%.

The emulsion thus prepared was washed for desalting. The yield of the resulted emulsion was 800 ml.

Further, the photosensitive silver halide emulsions were prepared from the preceding silver bromoiodide emulsion as follows:

(a) Preparation of a red photosensitive silver halide emulsion

| | |
|---|---|
| Silver bromoiodide emulsion | 700 ml |
| 4-hydroxy-6-methyl-1,3,3a,7-tetrazaindene | 0.4 g |
| Gelatin | 32 g |
| Sodium thiosulfate | 10 mg |
| Sensitizing dye (a) | 80 ml |
| (in a 1% methanol solution) | |
| Distilled water | 1200 ml |

-continued

Sensitizing dye (a)

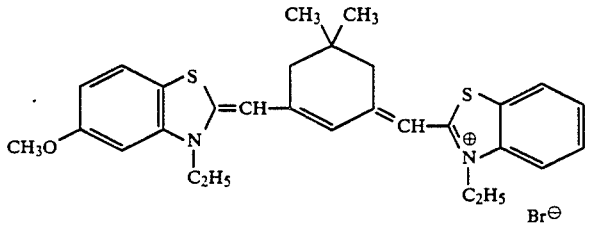

(b) Preparation of green-sensitive silver halide emulsion

| | |
|---|---|
| Silver bromoiodide emulsion | 700 ml |
| 4-hydroxy-6-methyl-1,3,3a,7-tetrazaindene | 0.4 g |
| Gelatin | 32 g |
| Sodium thiosulfate | 10 mg |
| Sensitizing dye (b) | 80 ml |
| (in a 1% methanol solution) | |
| Distilled water | 1200 ml |

Sensitizing dye (b)

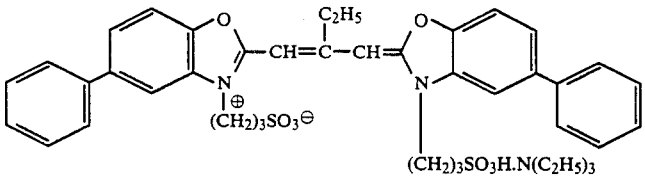

(c) Preparation of blue-sensitive silver halide emulsion

| | |
|---|---|
| Silver bromoiodide emulsion | 700 ml |
| 4-hydroxy-6-methyl-1,3,3a,7-tetrazaindene | 0.4 g |
| Gelatin | 32 g |
| Sodium thiosulfate | 10 mg |
| Sensitizing dye (c) | 80 ml |
| (in a 1% methanol solution) | |
| Distilled water | 1200 ml |

Sensitizing dye (c)

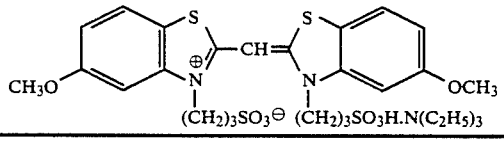

[Preparation of organic silver salt dispersion]

The reaction of 5-methylbenzotriazole and silver nitrate was performed in a water-alcohol mixed solvent. 28.8 g of resulted silver 5-methylbenzotriazole, 16.0 g of poly(N-vinylpyrolidone) and 1.33 g of sodium 4-sulfobenzotriazole were dispersed by an alumina ball mill. pH of the dispersion was adjusted to 5.5, and 200 ml of organic silver salt dispersion were prepared.

[Preparation of dye-donor dispersion]

225 g of the following dye-donor M-1, 1.0 g of the following antifoggant and 10.6 g of the inventive compound SC-3 were dissolved in 600 ml of ethyl acetate. The resulted solution was mixed with 248 ml of a 5 wt% aqueous solution of Alkanol XC (manufactured by DuPont) and 1440ml of an aqueous gelatin solution containing 61 g of photographic grade gelatin. The resulted mixture was dispersed by a supersonic homogenizer, and then ethyl acetate was distilled off. pH of the dispersion was adjusted to 5.5, and 1590 ml of the dispersion was prepared

M-1

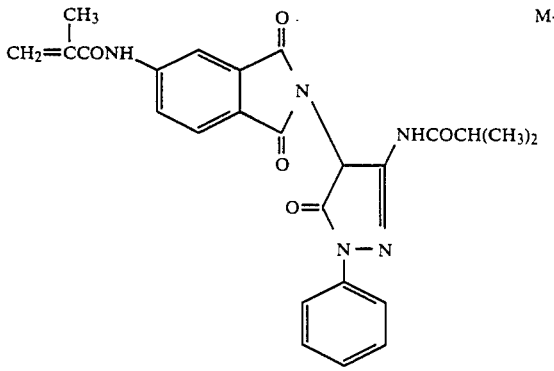

Copolymer of M-1 and t-butyl acrylate
(Composition ratio: 3/2
Molecular weight: 23,000)

-continued

Antifoggant

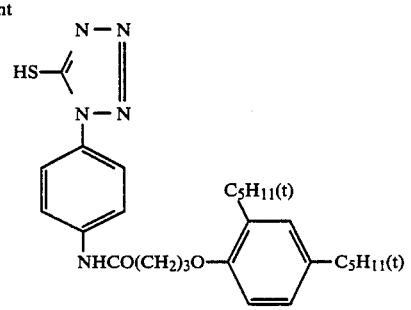

[Preparation of reducing agent solution]

65.2 g of the following reducing agent A and 30 g of a reducing agent B were dissolved in a solution consisting of 207 ml of a 20 wt% aqueous solution of polyvinyl pyrolidone K-30 40 ml of a 5 wt% aqueous solution of surfactant shown below. To the resulted solution was added water and an aqueous citric acid solution, and 600 ml of a reducing agent solution having a pH value of 7.0 were obtained.

Surfactant

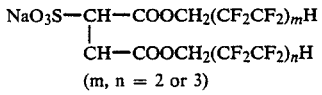

(m, n = 2 or 3)

Reducing agents

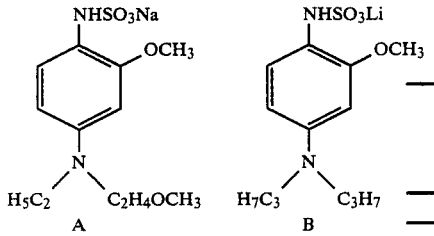

[Preparation of heat solvent dispersion]

430 g of p-toluamide and 1410 ml of a 1.0 wt% aqueous solution of polyvinylpyrolidone (K-30) were mixed and dispersed by a ball mill to prepare a heat solvent dispersion.

[Preparation of heat-processable photosensitive material/ Sample No. 1]

A coating solution having the following composition was prepared from a preceding silver bromoiodide emulsion, an organic silver salt dispersion, a dye-donor dispersion, a reducing agent solution and a heat solvent dispersion. The resulted solution was coated over a 180μm thickness transparent polyethylene terephthalate film of a photographic grade, provided thereon with an under-coat layer, so as to have a wet thickness of 110μm. After drying it, a heat-processable photosensitive material, Sample No. 1, was obtained.

| Composition of coating solution | |
|---|---|
| Organic silver salt dispersion | 64 ml |
| Green-sensitive silver bromoiodide emulsion | 30.7 ml |
| Reducing agent solution | 38.4 ml |
| Heat solvent dispersion | 94.8 ml |
| Dye-donor dispersion | 101 ml |
| 10 wt % aqueous solution of photographic gelatin | 21.1 ml |
| 10 wt % aqueous solution of phenylcarbamoylated gelatin | 27.7 ml |
| Aqueous citric acid solution and water (Adjusted to pH 5.5) | 53 ml |
| Hardener solution | 50 ml |
| Tetra(vinyl sulfonyl methyl)methane and t-taurine were reacted at a weight ratio of 1:1 and the resulted matter was dissolved in an aqueous 1% phenylcarbamoylated gelatin solution, and a tetra(vinylsulfonylmethyl)methane proportion was adjusted to 3 wt % | |
| Total | 480 ml |

[Preparation of image-receiving material]

An image-receiving material was prepared by coating a coating solution having the following composition over a photographic baryta paper so as to have a wet thickness of 140μm.

| | |
|---|---|
| Polyvinyl chloride, n = 1100 (manufactured by Wako Junyaku Co.) | 21.0 g |
| Compound (C) | 1.68 g |
| Compound (D) | 0.8 g |
| Tetrahydrofuran | 190 ml |

| Compound (C) | Compound (D) |
|---|---|
| 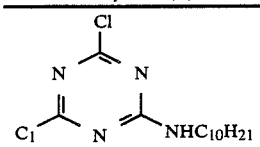 | 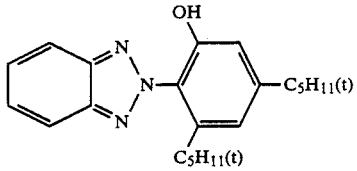 |

[Evaluation of photosensitive materials]

The photosensitive materials prepared in the preceding process were exposed to green-light having 800 CMS through a step-wedge. Next, the image-receiving layer surface of the preceding image-receiving material and the photosensitive layer surface of the exposed photosensitive material were sticked each other and were heat-developed at 150° C. for 90 seconds. Then the image-receiving material was peeled off, and a transferred magenta image was obtained on it. With respect to thus obtained magenta image, there were made the measurements of the maximum reflection density (Dmax), the minimum reflection density (Dmin) and the sensitivity value relative to that of a photosensitive material without containing the inventive, compounds which was set at 100. The results are shown in Table-1.

Example-2

The photosensitive materials/Sample No. 2 and No. 3 were prepared in the same manner as Example-1, except that the amount of the inventive compound SC-3 was changed as shown in Table-1, respectively. Further, Sample No. 4 through No. 14 were prepared, wherein the inventive compounds were added in the amounts as shown in Table-1 (Sample 4 to 13) and no inventive compound was added (Sample No. 14). Then, they were exposed to light and heat-processed in the same procedure as Example 1.

The results thereof are also shown in Table-1.

TABLE-1

| Sample No. | Inventive compound | Amount added (per mol of dye-donor) | Relative sensitivity | Dmax | Dmin | Remarks |
|---|---|---|---|---|---|---|
| 1 | SC-3 | 0.3 mol | 150 | 2.24 | 0.12 | Invention |
| 2 | " | 0.2 mol | 150 | 2.28 | 0.14 | Invention |
| 3 | " | 0.4 mol | 125 | 2.15 | 0.09 | Invention |
| 4 | SC-1 | 0.3 mol | 100 | 2.22 | 0.19 | Invention |
| 5 | " | 0.4 mol | 125 | 2.19 | 0.18 | Invention |
| 6 | SC-5 | 0.3 mol | 150 | 2.27 | 0.13 | Invention |
| 7 | SC-6 | 0.3 mol | 150 | 2.21 | 0.14 | Invention |
| 8 | SC-7 | 0.3 mol | 150 | 2.25 | 0.14 | Invention |
| 9 | SC-8 | 0.3 mol | 125 | 2.27 | 0.15 | Invention |
| 10 | SC-10 | 0.3 mol | 125 | 2.26 | 0.16 | Invention |
| 11 | SC-11 | 0.3 mol | 100 | 2.19 | 0.20 | Invention |
| 12 | A | 0.3 mol | 75 | 1.83 | 0.19 | Comparative |
| 13 | B | 0.3 mol | 50 | 1.61 | 0.15 | Comparative |
| 14 | — | 0 mol | 100 | 2.35 | 0.25 | Comparative |

A

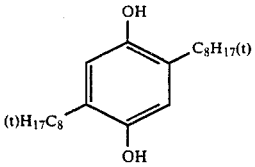

B Copolymer of

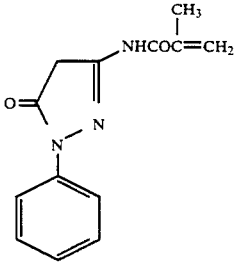

and BA <Composition ratio: 1/1 by weight ratio>

Example-3

Samples No. 1 through No. 14 of the photosensitive materials in Examples 1 and 2 were allowed to stand at 50° C., 80% RH for 24 hours and were then exposed and processed in the same manners as Example-1.

The results are shown in Table-2.

TABLE 2

| Sample No. | Dmax | Dmin | Remark |
|---|---|---|---|
| 1 | 2.25 | 0.14 | Invention |
| 2 | 2.29 | 0.16 | " |
| 3 | 2.16 | 0.12 | " |
| 4 | 2.21 | 0.21 | " |
| 5 | 2.22 | 0.20 | " |
| 6 | 2.29 | 0.15 | " |
| 7 | 2.24 | 0.16 | " |
| 8 | 2.28 | 0.15 | " |
| 9 | 2.27 | 0.18 | " |
| 10 | 2.27 | 0.19 | " |
| 11 | 2.20 | 0.23 | " |
| 12 | 1.87 | 0.33 | Comparison |
| 13 | 1.62 | 0.22 | " |
| 14 | 2.41 | 0.49 | " |

As shown in Table-2, it has been fOund that the photosensitive materials containing the inventive compounds have almost no fog increase during storage and are improved in preservability.

Example-4

The coating solution for the photosensitive materials described in Example-1 was coated over a b 180μm thickness photographic transparent polyethylene terephthalate film support provided with an under-coat layer so as to have a wet layer thickness of 70μm, and dried. Thus, the 1st photosensitive layer was provided on the film support.

Further, the 1st interlayer of the following composition was coated over the 1st photosensitive layer.

| (Composition of first interlayer) | |
|---|---|
| Gelatin | 0.9 g/m$^2$ |
| SC-3 | 0.2 g/m$^2$ |
| p-toluamide | 1.0 g/m$^2$ |
| Sodium 2,4-dichloro-6-hydroxy-S-triazine | 20 mg/m$^2$ |

The coating solution which had the same composition as Example-1, except that the dye-donor of Example-1 and silver halide emulsion were replaced by the following cyan dye-donor material and the red-sensitive silver bromoiodide emulsion described in Example-1, respectively, was coated over the 1st interlayer in a wet layer thickness of 60μm to form the 2nd photosensitive layer. Thus, a multilayer photosensitive material/Sample No. 15 was prepared.

Cyan dye-donor

Copolymer of

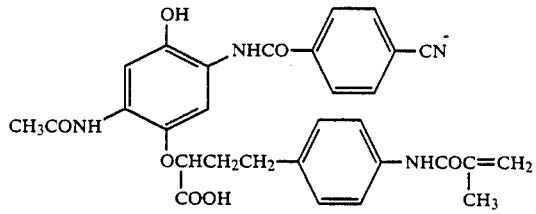

and butyl acrylate

<Composition ratio by weight: 1/1

Molecular weight: 28,000>

Further, Sample No. 16 through No. 22 were prepared by changing the inventive compounds contained in the photosensitive layers and interlayers in combinations as shown in Table-3.

The photosensitive materials were exposed to green light and red light and processed in the same manner as Example-1. Each density of the magenta and cyan images was measured to each exposure.

TABLE 3

| Sample No. | Compound of the invention (amount added) Photosensitive layer (in mol) | | Interlayer (in g/m²) | | Dmax Green light exposure | Dmax Red light exposure | Dmin Green light exposure | Dmin Red light exposure | Remarks |
|---|---|---|---|---|---|---|---|---|---|
| 15 | SC-3 | 0.3 | SC-3 | 0.2 | 2.08 | 0.81 | 0.13 | 0.11 | Invention |
| | | | | | 0.18 | 1.98 | 0.04 | 0.06* | |
| 16 | SC-3 | 0.3 | SC-7 | 0.2 | 2.11 | 0.82 | 0.12 | 0.10 | Invention |
| | | | | | 0.19 | 1.99 | 0.04 | 0.05 | |
| 17 | None | | SC-7 | 0.2 | 2.25 | 0.87 | 0.22 | 0.21 | Invention |
| | | | | | 0.20 | 2.10 | 0.11 | 0.10 | |
| 18 | SC-7 | 0.3 | SC-7 | 0.2 | 2.05 | 0.80 | 0.12 | 0.11 | Invention |
| | | | | | 0.17 | 1.95 | 0.05 | 0.06 | |
| 19 | SC-7 | 0.3 | None | | 2.06 | 1.04 | 0.13 | 0.12 | Invention |
| | | | | | 0.23 | 1.97 | 0.05 | 0.06 | |
| 20 | None | | None | | 2.18 | 1.31 | 0.24 | 0.25 | Comparison |
| | | | | | 0.24 | 2.09 | 0.13 | 0.12 | |
| 21 | A | 0.3 | B | 0.2 | 1.75 | 0.69 | 0.12 | 0.11 | Comparison |
| | | | | | 0.16 | 1.69 | 0.05 | 0.06 | |
| 22 | B | 0.3 | B | 0.2 | 1.59 | 0.63 | 0.10 | 0.11 | Comparison |
| | | | | | 0.13 | 1.52 | 0.05 | 0.06 | |

*Dmax and Dmin columns: The upper corresponds to magenta density in exposure to green light, and the lower corresponds to cyan density to red light.

It has been obvious from Table-3 that the inventive compounds added to a photosensitive layer result in lowering Dmin, without seriously inhibiting Dmax and that the inventive compounds added to an interlayer contribute to preventing efficiently a color mixing.

Example-5

On the 2nd photosensitive layer of Sample No. 16 in Example-4 was provided the 2nd interlayer containing the following yellow filter dye FY (0.15 g/m²) as well as the same composition as that of the 1st interlayer of Example-4.

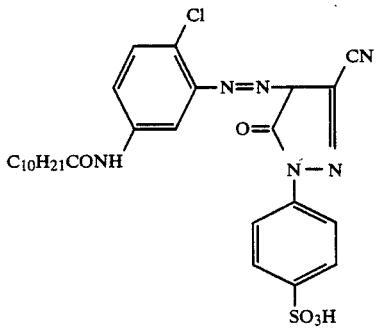

(FY)

On the 2nd interlayer was further provided the 3rd photosensitive layer by a coating the solution having the same composition as Example-1, except that the dye-donor of Example-1 and a silver halide emulsion were replaced by the following yellow dye-donor Y and the blue sensitive silver bromoiodide emulsion of Example-1, respectively, so as to have a wet layer thickness of 75μm.

Dye-donor Y

Copolymer of

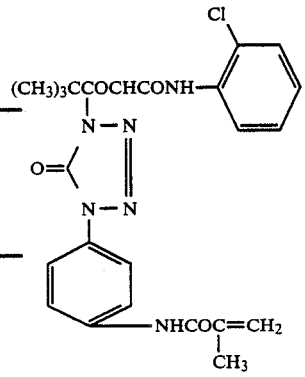

and BA

<Composition ratio: 7:3 by weight
Molecular weight: 23,000>

A protective layer having the following composition was provided on the 3rd photosensitive layer to prepare a multilayered photosensitive material/Sample No. 23.

| Protective layer | |
|---|---|
| Gelatin | 0.4 g/m² |
| $SiO_2$ | 0.36 g/m² |
| p-toluamide | 0.42 g/m² |

The photosensitive material/Sample 23 was exposed to red, green and blue light through a step wedge, respectively. and the images having excellent purity of cyan, magenta and yellow color were obtained.

The maximum density, Dmax and the minimum density, Dmin of the images are shown in Table-4.

TABLE 4

| | Dmax | Dmin |
|---|---|---|
| Cyan | 1.89 | 0.05 |
| Magenta | 1.95 | 0.11 |
| Yellow | 1.94 | 0.08 |

What is claimed is:

1. A method of processing a heat-processable color photosensitive material comprising a support, provided thereon, a photosensitive layer containing a photosensitive silver halide, a dye-donor, a reducing agent and a binder, and a non-photosensitive layer containing at least a binder, wherein a coupler capable of coupling with an oxidized product of the reducing agent to form a substantially colorless product is contained in at least one layer selected from the group consisting of the photosensitive layer and the non-photosensitive layer, and is represented by Formulas (2) to (9);

Formula (2)

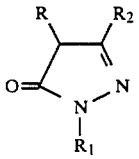

Formula (3)

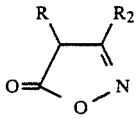

Formula (4)

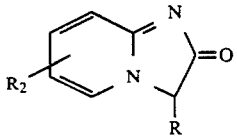

Formula (5)

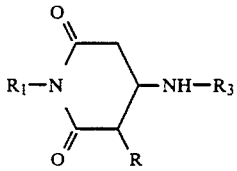

Formula (6)

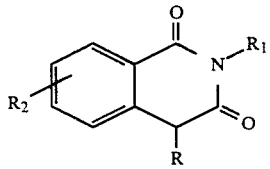

Formula (7)

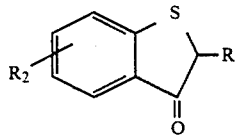

Formula (8)

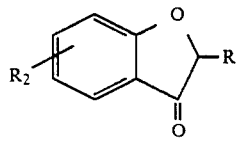

Formula (9)

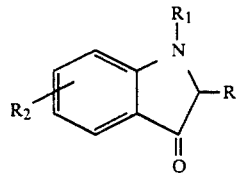

wherein R represents one selected from the group consisting of an alkyl group and an aryl group; $R_1$ and $R_3$ independently represent an alkyl group or an aryl group; $R_2$ represents an alkyl group, an aryl group, an alkylamino group, an arylamino group, an acylamino group, an ureido group, a cyano group or a carbamoyl group.

2. The method of claim 1, wherein said photosensitive material is developed by heating at a temperature range of 80° to 200° C.

3. The method of claim 2, wherein the photosensitive material is developed by heating at a temperature range of 100° to 170° C.

4. The method of claim 1, wherein the photosensitive material is developed by heating in 1 to 180 seconds.

5. The method of claim 4, wherein the photosensitive material is developed by heating in 1.5 to 120 seconds.

6. The method of claim 1, wherein the coupler is substituted at an active site with R representing the alkyl group or the aryl group, each substituted or non-substituted.

7. The method of claim 6, wherein the coupler is substituted with the alkyl group.

8. The method of claim 7, wherein the alkyl group is a methyl, ethyl, n-propyl, n-butyl, n-octyl, n-dodecanyl or n-octadecanyl group.

9. The method of claim 8, wherein the alkyl group is a methyl or ethyl group.

10. The method of claim 6, wherein the aryl group is a phenyl group.

11. The method of claim 6, wherein the alkyl group or the aryl group is substituted with an aryl group, an alkoxy group, a hydroxy group, a sulfamoyl group or a carbamoyl group.

12. The method of claim 1, wherein R is combined with $R_2$or $R_3$ to form a ring.

13. The method of claim 1, wherein the coupler is represented by Formula (3).

14. The method of claim 1, wherein an amount of said coupler added to the photosensitive layer is 0.01 to 1.0 mol per mol of a dye-donor.

15. The method of claim 14, wherein the amount is 0.05 to 0.5 mol per mol of the dye-donor.

16. The method of claim 1, wherein an amount of said coupler added to the non-photosensitive layer is $1.0\times10^{-5}$ to $1.0\times10^{-2}$ mol per $m^2$ of the layer.

17. The method of claim 16, wherein the amount is $1.0\times10^{-4}$ to $5.0\times10^{-3}$ mol per $m^2$ of the layer.

18. The method of claim 1, wherein said dye-donor is represented by Formula(10);

$$Cp\text{-}(J)(B) \qquad \text{Formula (10)}$$

wherein Cp represents an organic group capable of coupling with an oxydized product of a reducing agent to form a diffusible dye; J represents a divalent joint group substituted at an active site of the dye-donor; and B represents a ballast group which contributes to inhibiting diffusion of the dye-donor in heat processing.

19. The method of claim 18, wherein a molecular weight of Cp is not more than 700.

20. The method of claim 18, wherein the molecular weight is not more than 500.

21. The method of claim 18, wherein the ballast group comprises a sulfo group or a group having more carbon atoms than eight.

22. The method of claim 18, wherein the ballast group comprises a sulfo group and a group having more carbon atoms than eight.

23. The method of claim 1, wherein said dye-donor is represented by Formula (11);

Cp-(-J)(Y)$_l$(Z)(L) Formula (11)

wherein Cp and J represent the same as in Formula(10); Y represents an alkylene group, an arylene group or an aralkylene group; l represents 0 or 1; Z represents a divalent organic group; and L represents an unsaturated ethylene group or a group comprising an unsaturated ethylene group.

24. The method of claim 23, wherein an addition rate of the dye-donor is 0.005 to 50 g per $m^2$ of the photosensitive material.

25. The method of claim 24, wherein the addition rate is 0.1 to 10 g per $m^2$ of the photosensitive material.

26. A heat-processable color photosensitive material comprising a support, provided thereon, a photosensitive layer containing a photosensitive silver halide, a dye-donor, a reducing agent and a binder, and a non-photosensitive layer containing at least a binder, wherein a coupler capable of coupling with an oxidized product of the reducing agent to form a substantially colorless product is contained in at least one layer selected from the group consisting of the photosensitive layer and the non-photosensitive layer, and is represented by Formulas (2) to (9);

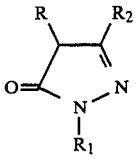
Formula (2)

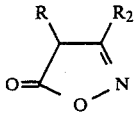
Formula (3)

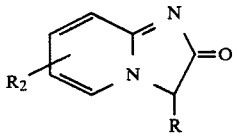
Formula (4)

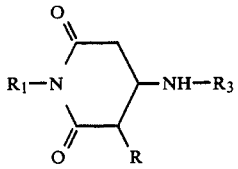
Formula (5)

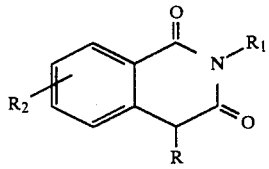
Formula (6)

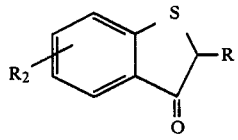
Formula (7)

-continued

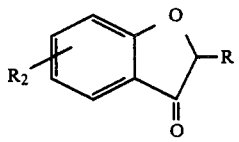
Formula (8)

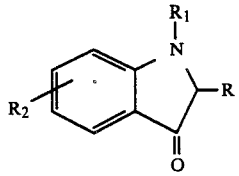
Formula (9)

wherein R represents one selected from the group consisting of an alkyl group and an aryl group; $R_1$ and $R_3$ independently represent an alkyl group or an aryl group; $R_2$ represents an alkyl group, an aryl group, an alkylamino group, an arylamino group, an acylamino group, an ureido group, a cyano group or a carbamoyl group.

27. The photosensitive material of claim 26, wherein the coupler is substituted at an active site with R representing the alkyl group or the aryl group, each substituted or nonsubstituted.

28. The photosensitive material of claim 27, wherein the coupler is substituted with the alkyl group.

29. The photosensitive material of claim 8, wherein the alkyl group is a methyl, ethyl, n-propyl, n-butyl, n-octyl, n-dodecanyl or n-octadecanyl group.

30. The photosensitive material of claim 29, wherein the alkyl group is a methyl or ethyl group.

31. The photosensitive material of claim 27, wherein the alkyl group or the aryl group is substituted with an aryl group, an alkoxy group, a hydroxy group, a sulfamoyl group or a carbamoyl group.

32. The photosensitive material of claim 26, wherein R is combined with $R_2$ or $R_3$ to form a ring.

33. The photosensitive material of claim 26, wherein the coupler is represented by Formula (3).

34. The photosensitive material of claim 26, wherein an amount of said coupler added to the photosensitive layer is 0.01 to 1.0 mol per mol of a dye-donor.

35. The photosensitive material of claim 34, wherein the amount is 0.05 to 0.5 mol per mol of the dye-donor.

36. The photosensitive material of claim 26, wherein an amount of said coupler added to the non-photosensitive layer is $1.0\times10^{-5}$ to $1.0\times10^{-2}$ mol per $m^2$ of the layer.

37. The photosensitive material of claim 36, wherein the amount is $1.0\times10^{-4}$ to $5.0\times10^{-3}$ mol per $m^2$ of the layer.

38. The photosensitive material of claim 26, wherein said dye-donor is represented by Formula(10);

Cp-(-J)(B) Formula (10)

wherein Cp represents an organic group capable of coupling with an oxydized product of a reducing agent to form a diffusible dye; J represents a divalent joint group substituted at an active site of the dye-donor; and B represents a ballast group which contributes to inhibiting diffusion of the dye-donor in heat processing.

39. The photosensitive material of claim 38, wherein a molecular weight of Cp is not more than 700.

40. The photosensitive material of claim 39, wherein the molecular weight is not more than 500.

41. The photosensitive material of claim 38, wherein the ballast group comprises a sulfo group or a group having more carbon atoms than eight.

42. The photosensitive material of claim 38, wherein the ballast group comprises a sulfo group and a group having more carbon atoms than eight.

43. The photosensitive material of claim 38, wherein said dye-donor is represented by Formula(11);

$$Cp\text{-}(J)(Y)_l(Z)(L) \qquad \text{Formula (11)}$$

wherein Cp and J represent the same as in Formula(10); Y represents an alkylene group, an arylene group or an aralkylene group; l represents 0 or 1; Z represents a divalent organic group; and L represents an unsaturated ethylene group or a group comprising an unsaturated ethylene group.

44. The photosensitive material of claim 26, wherein an addition rate of said dye-donor is 0.005 to 50 g per $m^2$ of the photosensitive material.

45. The photosensitive material of claim 44, wherein the addition rate is 0.1 to 10 g per $m^2$ of the photosensitive material.

46. The photosensitive material of claim 27, wherein the aryl group is a phenyl group.

* * * * *